US006007358A

United States Patent [19]

Nagase

[11] Patent Number: 6,007,358

[45] Date of Patent: Dec. 28, 1999

[54] CONNECTOR FOR ELECTRICAL SUPPLY BUS WITH THICK SHAFT PORTION ACTUATED WEDGE BLOCKS

[75] Inventor: Satoru Nagase, Tokyo, Japan

[73] Assignee: NEC Corporation, Tokyo, Japan

[21] Appl. No.: 09/113,290

[22] Filed: Jul. 10, 1998

[30] Foreign Application Priority Data

Jul. 11, 1997 [JP] Japan ..... 9-202428

[51] Int. Cl.[6] ..... H01R 13/62

[52] U.S. Cl. ..... 439/327; 361/727

[58] Field of Search ..... 439/327; 361/683, 361/684, 685, 724, 727, 707, 704; 403/409.1; 165/80.2

[56] References Cited

U.S. PATENT DOCUMENTS

| | | | |
|---|---|---|---|
| 1,217,539 | 2/1917 | Underwood | 254/42 |
| 3,971,186 | 7/1976 | Havelka et al. | 403/374.4 |
| 4,298,904 | 11/1981 | Koenig | 361/720 |
| 4,318,157 | 3/1982 | Rank et al. | 361/704 |
| 4,354,770 | 10/1982 | Block | 403/409.1 |
| 4,414,605 | 11/1983 | Chino et al. | 361/707 |
| 4,480,287 | 10/1984 | Jensen | 361/707 |
| 4,751,963 | 6/1988 | Bui et al. | 165/80.2 |
| 4,775,260 | 10/1988 | Kecmer | 403/409.1 |
| 4,819,713 | 4/1989 | Weisman | 165/80.2 |
| 5,253,963 | 10/1993 | Ries | 411/75 |
| 5,407,297 | 4/1995 | Hulme et al. | 403/409.1 |

FOREIGN PATENT DOCUMENTS

| | | |
|---|---|---|
| 55-28134 | 2/1980 | Japan . |
| 55-14849 | 11/1980 | Japan . |
| 2-248762 | 10/1990 | Japan . |
| 5-226009 | 9/1993 | Japan . |

*Primary Examiner*—Khiem Nguyen
*Assistant Examiner*—Michael Zarroli
*Attorney, Agent, or Firm*—Sughrue, Mion, Zinn, Macpeak & Seas, PLLC

[57] ABSTRACT

A connecting structure of an electrical supply bus, by which a power supply module or a logic package is easily mounted in a case for an electronic device. The connecting structure of an electrical supply bus consists of: guide rails provided with a plurality of wedge-like spaces; a plurality of wedge-like blocks respectively accommodated in the plurality of wedge-like spaces; a stepped shaft which is inserted into a through hole provided in each of the guide rails and has a plurality of thick shaft portions; and an electrical supply bus facing the guide rails. An external thread portion of the stepped shaft is fitted into an internal thread portion of the guide rail. Thus, when the operating portion is rotated, the stepped shaft moves in the direction of said shaft. Then, each of the thick shaft portions moves a corresponding one of the wedge-like blocks. Thus, each of the wedge-like blocks pushes the electrical supply bus against the guide rails.

10 Claims, 8 Drawing Sheets

CONNECTOR FOR ELECTRICAL SUPPLY BUS WITH THICK SHAFT PORTION ACTUATED WEDGE BLOCKS

BACKGROUND OF THE INVENTION

The present invention generally relates to a connecting structure of an electrical supply bus and, more particularly, to a connecting structure of an electrical supply bus for use in an electronic device such as a computer system.

Hitherto, electrical supply buses of this kind have been used as paths for supplying electric power to printed circuit boards of a computer system, as described in Japanese Unexamined Patent Publication (JP-A) No. 148493/1980 official Gazette (hereunder referred to as a first Official Gazette) or No. 28134/1980 official Gazette (hereunder referred to as a second official Gazette).

In the case of the electrical supply bus disclosed in the first Official Gazette, the electrical supply bus is connected to a power supply module or a logic package by using screws.

Namely, there has been devised a method by which a connecting portion of an electrical supply bus is placed at the rear side of a logic package and by which the electrical supply bus is connected to the logic package by tightening screws from the outside of a case after the logic package is inserted into the case.

In the case of another method employing the electrical supply bus disclosed in the second Official Gazette, coil springs are used at the rear side of a logic package. The electrical supply bus is pressed against the logic package by utilizing the pressure of the coil springs. Thus, the electrical supply bus is connected to the logic package.

The aforementioned two methods are examples of a method of connecting an electrical supply bus to the rear side of a card.

Another example of a conventional method is to insert an electrical supply bus 10, which is attached to a power supply module or a logic package 27, into a case 25 along guide rails 26 thereof and to then connect the electrical supply bus 10 to the guide rails 26 at a plurality of places on the contact surface between the bus 10 and each of the rails 26, as illustrated in perspective diagrams of FIGS. 1A and 1B.

FIG. 2 illustrates the conventional method of connecting the electrical supply bus to the guide rails at the plurality of places on the contact surface between the bus and each of the rails, and is an exploded perspective diagram showing an enlarged view of a connecting portion of the electrical supply bus, namely, a connecting portion between the bus and one of the rails.

Generally, the guide rails 19 are attached to the case 25, and the electrical supply bus 10 is attached to the power supply module or the logic package 27.

In the case of this example of the conventional method, screw holes 21 are formed in the guide rail 19 at a plurality of places. Screws 20 can be inserted into these holes from above, respectively.

Next, an operation of the conventional connecting structure of the electrical supply bus illustrated in FIG. 2 will be described hereinbelow.

FIG. 3 is a sectional diagram showing the connecting state of the electrical supply bus, which is taken on line E—E of FIG. 2. After the electrical supply bus 10 is inserted into the case along the guide rails 19, each of the screws 20 is tightened from the corresponding one of the screw holes 21. Thus, the tip end portion of each of the screws 20 pushes down the electrical supply bus 10 against the lower portion of the guide rail 19.

The electrical supply bus 10 is connected to each of the guide rails 19 by utilizing the forces of these screws 20.

FIG. 4 is a perspective diagram illustrating a structure for performing another conventional method of connecting the electrical supply bus to the guide rails at the plurality of places on the contact surface between the bus and each of the rails.

Further, FIG. 5 is a sectional diagram showing the connecting state of the electrical supply bus, which is taken on line F—F of FIG. 4. This conventional structure uses many connector contacts 23 for connecting the electric supply bus to the guide rails. The connector contacts 23 are placed in two rows or lines on both sides of the guide rail 22, respectively, so that the electrical supply bus 10 is sandwiched between the two rows of the connector contacts 23.

Next, an operation of the conventional structure illustrated in FIGS. 4 and 5 will be described hereinbelow.

When the electrical supply bus 10 is inserted onto the guide rails 22, the interval between the two lines of the connector contacts 23 increases. Then, the electrical supply bus 10 is connected to the guide rail 22 by utilizing the spring force generated in the connector contacts 23 at that time.

Additionally, there has been provided another example of the structure, which is provided with a mechanism 24 for connecting the electrical supply bus 10 to the guide rail 22 by preliminarily increasing the interval between the two rows of the connector contacts 23 when the electrical supply bus 10 is inserted thereonto, and by then narrowing the interval therebetween after the electrical supply bus 10 is inserted thereonto.

The aforementioned conventional structures, however, have the following problems.

First problem is that, in the structure using the screws for fixing the electrical supply bus which has been described as the example of the conventional method, it is difficult to tighten the screws for fixing the electrical supply bus onto the guide rails after the power supply module or the logic package is inserted into the case.

The reason is that the guide rails are mounted in the inside of the case. Thus, the screws for fixing the electrical supply bus should be tightened in the inside of the case. Especially, it is very difficult to tighten screws in an inner part, which does not allow a worker' hands to have access thereto, of the case.

Furthermore, there has been an example of a connecting structure in which a fixing-screw tightening portion of an electrical supply bus is placed at the rear side of a logic package and in which thus, screws for fixing the electrical supply bus are tightened from the outside of a case after the logic package is inserted into the case, similarly as the case of the connecting structure of the electrical supply bus described in the first Official Gazette. In the case of this example, although a connecting operation is simplified, only two places, at which the fixing screws are tightened, are assured for a single logic package. Therefore, the structure has too few connection places or points to supply a large or heavy current that is necessary for an operation of an apparatus such as a current large scale computer.

Second problem is that an operation of connecting the electrical supply bus is troublesome and time-consuming in the case of the connecting structure using the screws for fixing the electrical supply bus, which has been described as the conventional structure.

The reason is that a plurality of screws distributedly or dispersedly arranged on the guide rails should be individually tightened in the case of the hereinabove mentioned structure.

Third problem is that, in the case of the aforementioned conventional structure for connecting the electrical supply bus to the guide rails by using many connector contacts provided therein, a large force is needed when connecting the electrical supply bus.

The reason is that an inserting force increases at the time of inserting the electrical supply bus onto the guide rails as a result of connecting the bus thereto by utilizing the elasticity of may connector contacts in the aforementioned conventional structure.

Further, the problem of the inserting force is solved by the structure provided with a mechanism by which the electrical supply bus is connected to the guide rail by preliminarily increasing the interval between the two rows of the connector contacts when the electrical supply bus is inserted thereonto, and by then narrowing the interval therebetween after the electrical supply bus is inserted thereonto. However, the number of components increases with the result that the cost thereof rises.

Fourth problem is that it is difficult to ensure high reliability in the case of employing the structures which have been described as the conventional structures and which are adapted to connect the electrical supply bus to the power supply module and so on by using the coil springs and the many connector contacts.

The reason is that it is difficult to assure a contact pressure for a long time owing to the presence of a limit to the elasticity of the spring coils and the many connector contacts.

SUMMARY OF THE INVENTION

Accordingly, an object of the present invention is to provide a connecting structure of an electrical supply bus for easily mounting a power supply module or a logic package in a case for an electronic device.

Another object of the present invention is to provide a connecting structure of an electrical supply bus, by which an electrical supply bus can be securely brought into contact with guide rails.

To achieve the foregoing objects, in accordance with an aspect of the present invention, there is provided a connecting structure of an electrical supply bus for use in an electronic device having a case, guide rails fixed to the aforesaid case and an electrical supply bus. The aforesaid connecting structure comprises: the aforesaid guide rails provided with a plurality of wedge-like spaces; a plurality of wedge-like blocks respectively housed in the plurality of wedge-like spaces; a shaft with steps (namely, a stepped shaft), which is inserted in a hole provided in each of the aforesaid guide rails and has a plurality of thick shaft portions; and the aforesaid electrical supply bus placed in such a manner as to face the aforesaid guide rails. In this structure, as a result of a movement of the aforesaid stepped shaft in the direction of the shaft or an axis thereof, each of the aforesaid thick shaft portions causes a corresponding one of the aforesaid wedge-like blocks to move. Further, each of the aforesaid wedge-like blocks pushes the aforesaid electrical supply bus against the aforesaid guide rails.

Further, in accordance with another aspect of the present invention, there is provided a connecting structure of an electrical supply bus for use in an electronic device having a case, guide rails fixed to the aforesaid case and an electrical supply bus. The aforesaid connecting structure comprises: the aforesaid electrical supply bus provided wits a plurality of wedge-like spaces; a plurality of wedge-like blocks respectively housed in the plurality of wedge-like spaces; a shaft with steps which is inserted in a hole provided in the aforesaid electrical supply bus and has a plurality of thick shaft portions; and the aforesaid guide rails placed in such a manner as to face the aforesaid electrical supply bus. In this structure, as a result of a movement of the aforesaid stepped shaft in the direction of the shaft, each of the aforesaid thick shaft portions causes a corresponding one of the aforesaid wedge-like blocks to move. Further, each of the aforesaid wedge-like blocks pushes the aforesaid electrical supply bus against the aforesaid guide rails.

BRIEF DESCRIPTION OF THE DRAWINGS

Other features, objects and advantages of the present invention will become apparent from the following description of preferred embodiments with reference to the drawings in which like reference characters designate like or corresponding parts throughout several views, and in which.

DESCRIPTION OF THE PREFERRED EMBODIMENTS

Hereinafter, preferred embodiments of the present invention will be described in detail by referring to the accompanying drawings.

Figure 1A:
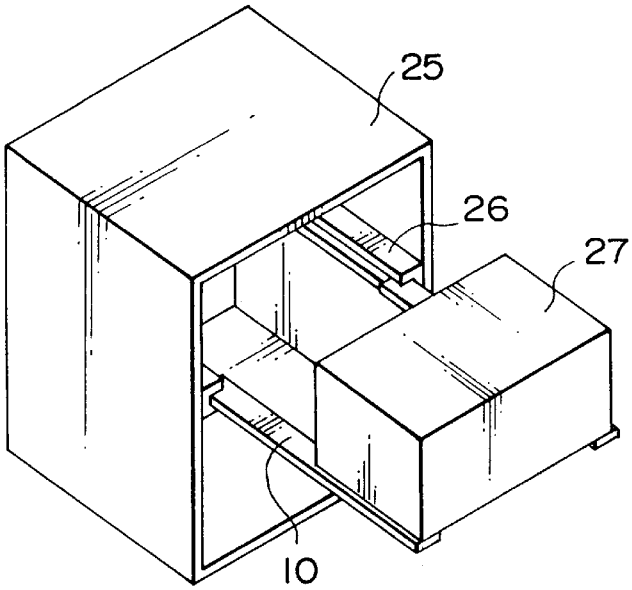
FIG. 1A PRIOR ART
FIG. 1A is a perspective diagram showing a conventional structure for mounting a power supply module and a logic package in a case.
Figure 1B:
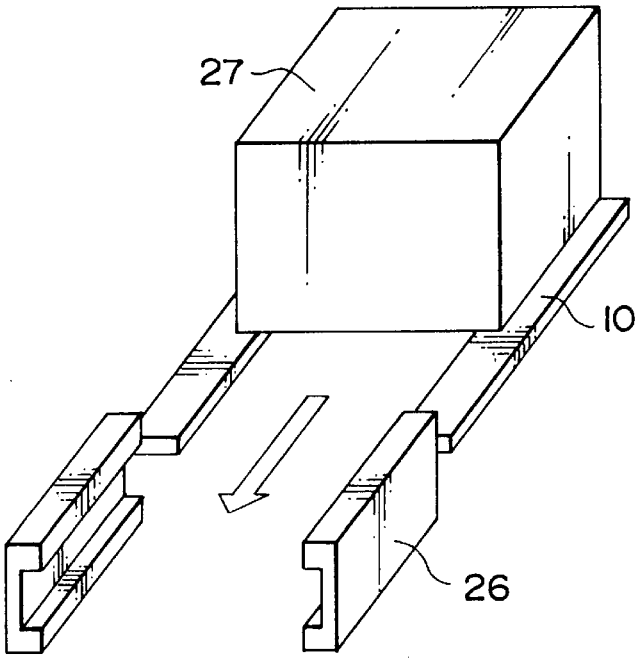
FIG. 1B PRIOR ART
FIG. 1B is a perspective diagram showing a primary part of the conventional structure of FIG. 1A.
Figure 2:
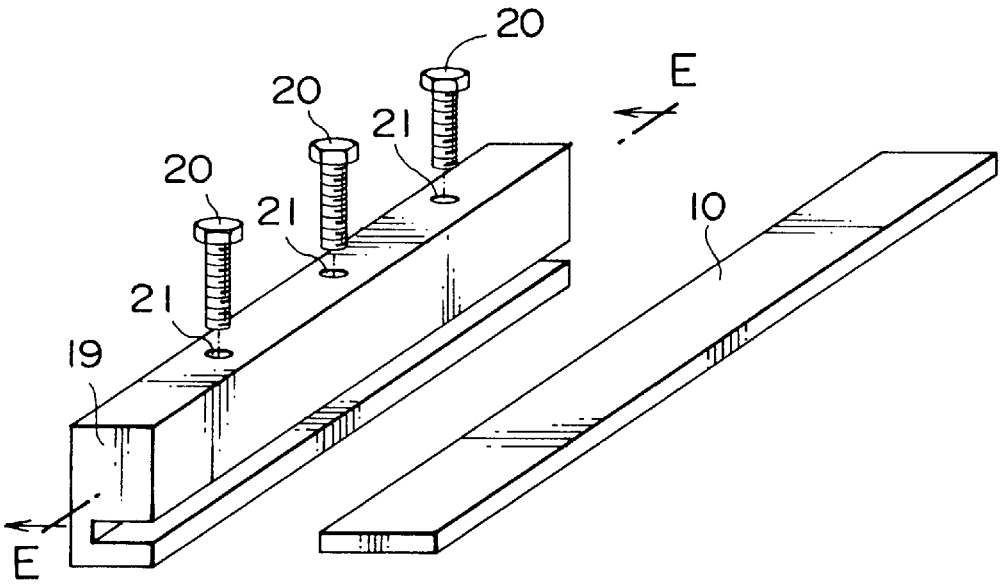
FIG. 2 PRIOR ART
FIG. 2 is a perspective diagram showing a conventional structure for connecting an electrical supply bus to a guide rail by screws.
Figure 3:
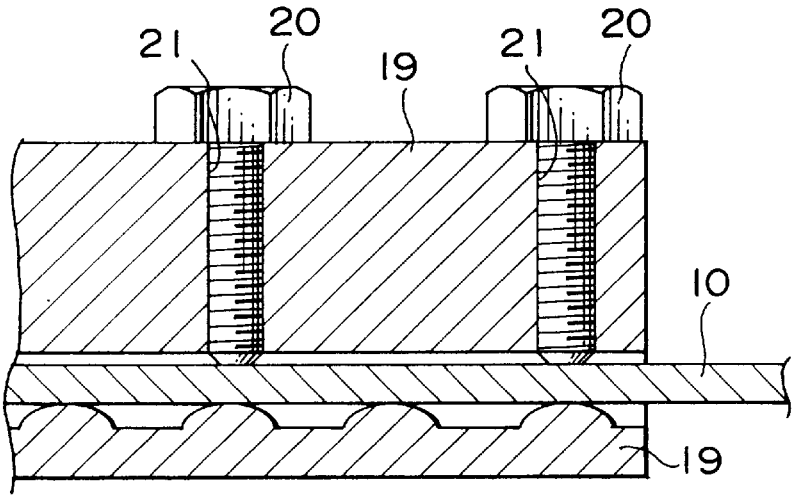
FIG. 3 PRIOR ART
FIG. 3 is a sectional diagram taken on line E—E of FIG. 2.
Figure 4:
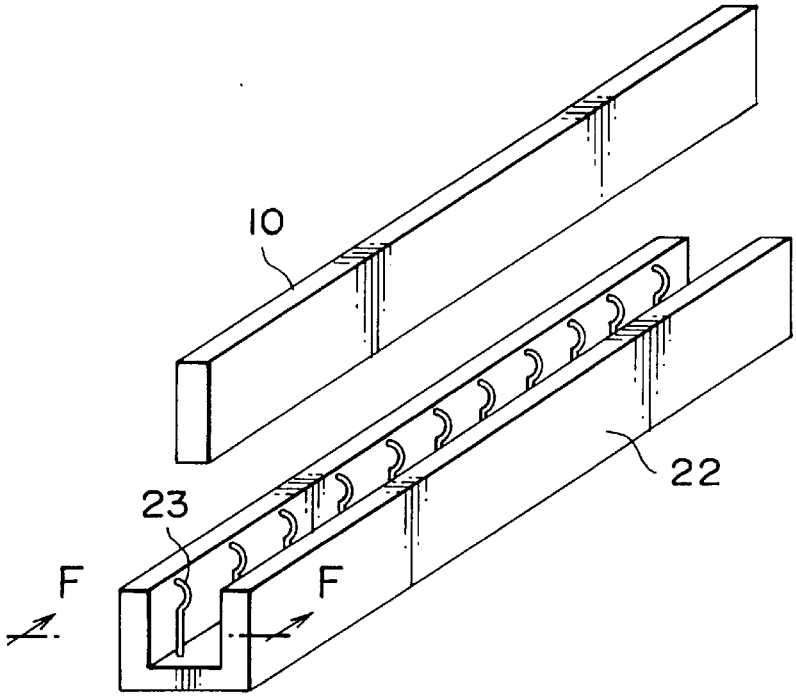
FIG. 4 PRIOR ART
FIG. 4 is a perspective diagram showing another conventional structure for connecting an electrical supply bus to a guide rail by springs.
Figure 5:
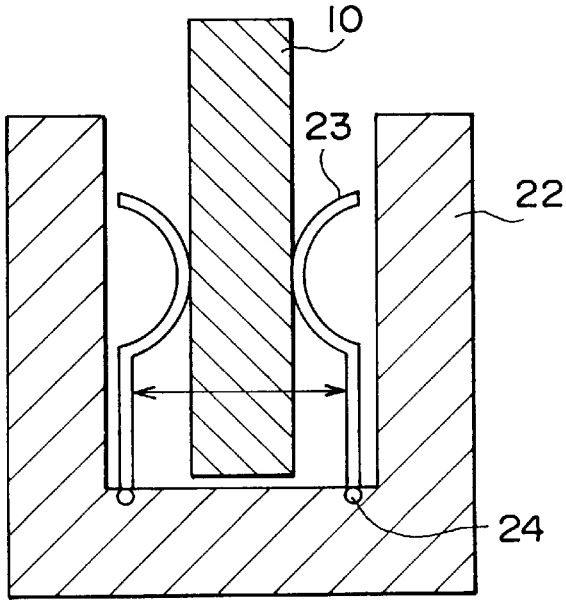
FIG. 5 PRIOR ART
FIG. 5 is a sectional diagram taken on line F—F of FIG. 4.
Figure 6A:
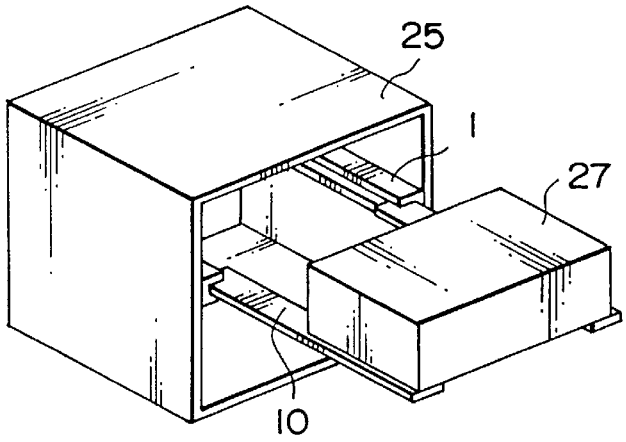
FIG. 6A is a perspective diagram showing a case for an electronic device to which a connecting structure of an electrical bus, namely, a first embodiment of the present invention is applied.

FIG. 6A is a diagram illustrating a first embodiment of the present invention, and sore particularly, is a perspective diagram showing the entire mounting structure of a power supply module or of a logic package.

An electrical supply bus 10 of the power supply module or of the logic package 27 is inserted into a case 25 along guide rails 1 attached thereto, and subsequently, the electrical supply bus 10 and the guide rails 1 are fixed therein. Thus, the electrical supply bus 10 is electrically connected thereto.

Figure 6B:
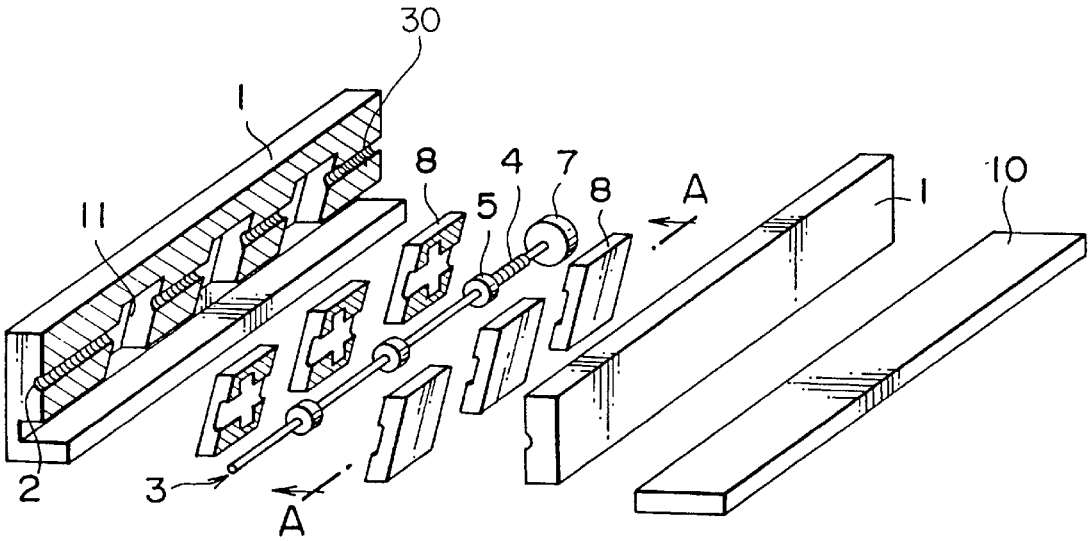
FIG. 6B is an exploded perspective diagram showing the connecting structure of the electrical bus which is the first embodiment of the present invention.

FIG. 6B is an exploded perspective diagram illustrating the configuration of the entire connecting structure of the electrical supply bus, which is the first embodiment of the present invention, and more particularly, is an enlarged view of the connecting portion among the electrical supply bus 10 and the guide rails 1.

The connecting structure of the electrical supply bus, which is the first embodiment of the present invention, is composed of the electrical supply bus 10, the guide rails 1, wedge-like blocks 8 and a stepped shaft 3 which has an external thread portion 4.

Figure 7:
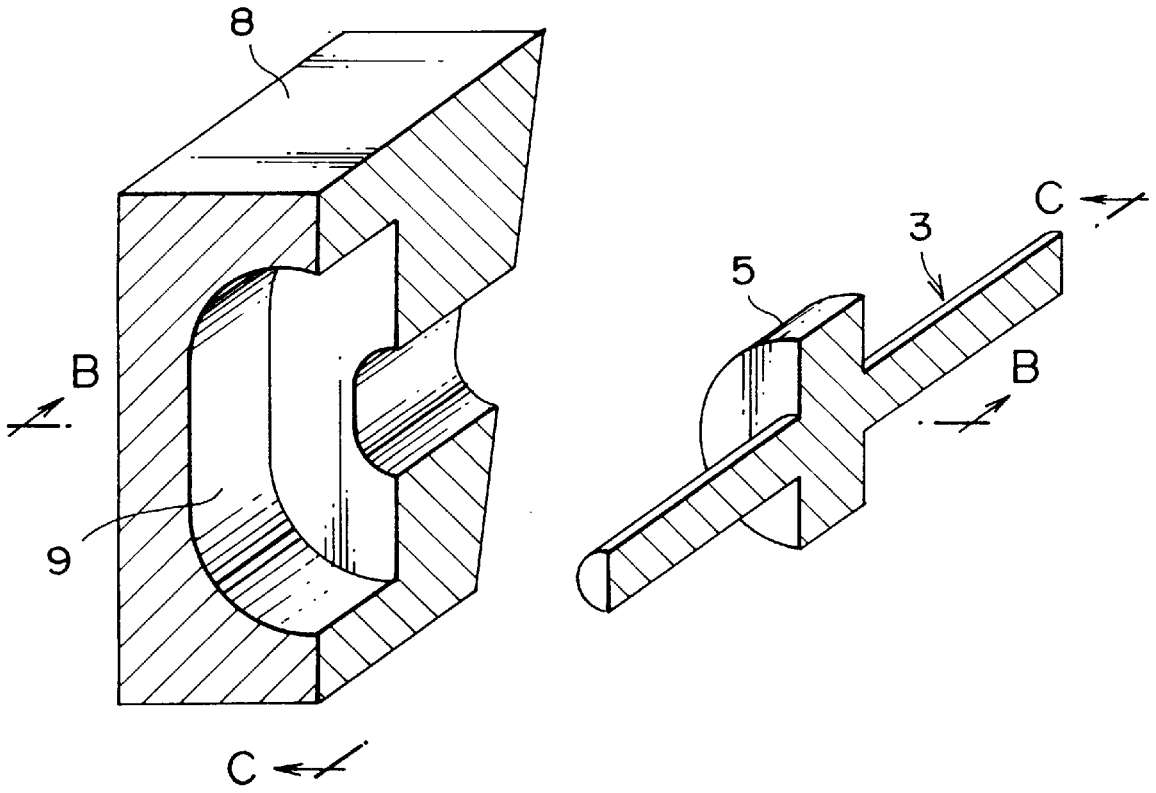
FIG. 7 is an exploded perspective diagram showing a wedge-like block and a stopped shaft of the connecting structure of the electrical bus which is the first embodiment of the present invention.

FIG. 7 is an exploded sectional perspective diagram showing the wedge-like block 8 and the stepped shaft 3 among the components of the first embodiment in the case of cutting the front portion and a side portion of each of the block 8 and the shaft 3 by using cutting planes which are parallel to the front face and a side face thereof. A stepped hole 9, through which the stepped shaft 3 passes, is provided in the inside of the wedge-like block 8.

As shown in FIG. 6B, each of the wedge-like blocks 8 is divided in two parts. Further, the wedge-like blocks 8 are assembled in such a manner that the stepped shaft 3 is sandwiched been the two parts thereof.

The structure is constructed so that, as a whole, a plurality of wedge-like blocks 8 are pierced with the single stepped shaft 3.

Figure 8A:
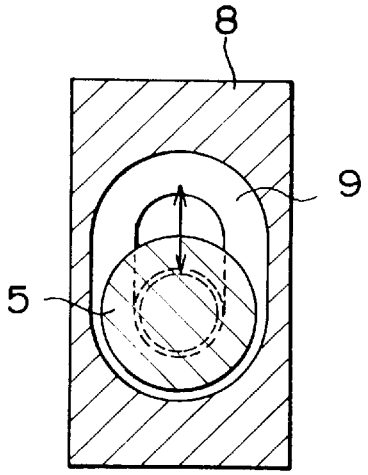
FIG. 8A is a sectional diagram taken on line B—B of FIG. 7 and illustrating the state where the stepped shaft is incorporated into the wedge-like block.
Figure 8B:
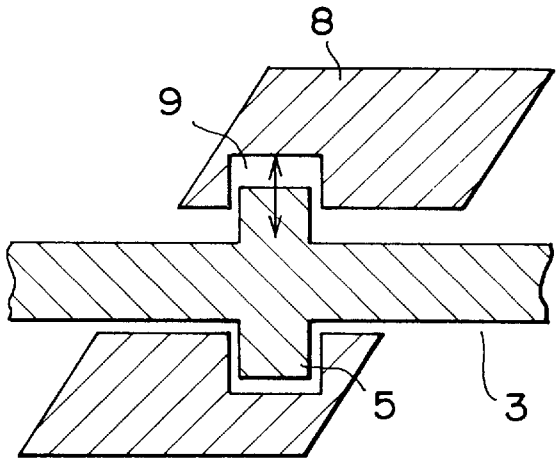
FIG. 8B is a sectional diagram taken on line C—C of FIG. 7 and illustrates the state where the stepped shaft is incorporated into the wedge-like block.

FIGS. 8A and 8B are sectional diagram that are taken on line B—B and line C—C of FIG. 7, respectively, and that show the state in which the stepped shaft 3 is incorporated into the wedge-like block 8.

As shown in FIG. 8A, the stepped hole 9 is dug in each of the wedge-like block 8 in such a manner that a horizontal section of the hole 9 is not completely circular but is shaped like an elongated curve. Even in the state where the stepped shaft 3 is contained in the hole 9 after assembled, there is an opening extending in the direction of an arrow in this figure.

Because of the structure having this opening, the wedge-like block 8 is adapted to be able to move in the direction of the arrow with respect to the stepped shaft 3.

Figure 9:
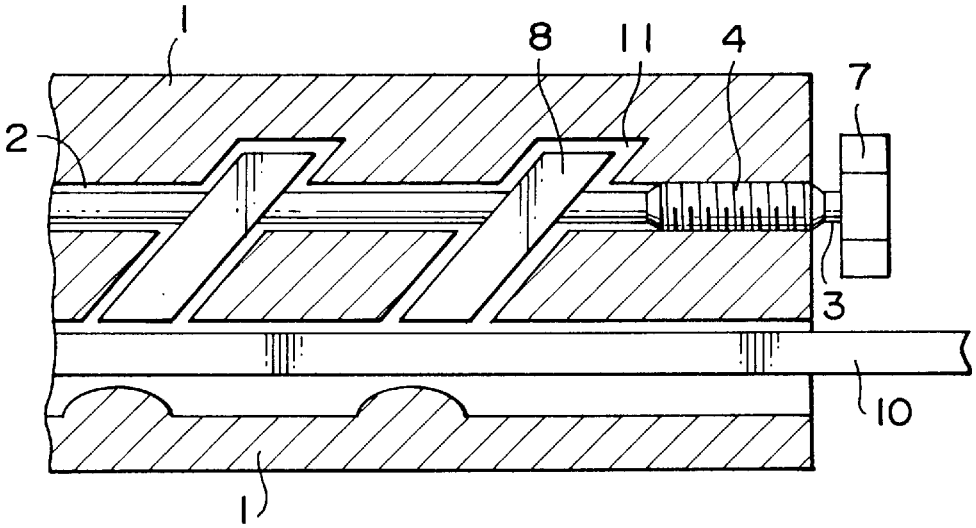
FIG. 9 is a sectional diagram taken on line A—A of FIG. 6B and illustrates the state where the components are assembled.

FIG. 9 is a sectional diagram taken on line A—A of FIG. 6B and illustrating the state of the structure after the components are assembled.

Referring to FIG. 9, there is shown the guide rail 1 where wedge-like spaces 11 respectively containing the wedge-like blocks 8 are formed and a through hole 2, through which the stepped shaft 3 passes through, is bored.

In the state where the components are assembled, there has been established a structure where the wedge-like blocks 8 are respectively inserted into the wedge-like spaces 11 and where the stepped shaft 3 penetrates the through hole 2 of the corresponding guide rail 1 and the stepped hole 9 of each of the wedge-like blocks 8.

Moreover, an internal thread portion 30 is provided at an end portion of the through hole 2 in the guide rail 1 and engages with the external thread portion 4 of the stepped shaft 3.

Furthermore, an operating portion 7 is attached to the one end of the stepped shaft 3 and protrudes from the guide rail 1 to the outside thereof and is adapted so that the entire stepped shaft 3 can be moved in the direction of the shaft or an axis thereof by rotating the operating portion 7.

Next, an operation of the first embodiment of the present invention will be described in detail hereinbelow.

To mount the power supply module in the case, the electric supply bus 10 at the side of the power supply module is inserted along the guide rails 1 at the side of the case thereinto. Then, the electrical supply bus 10 is connected to the guide rails 1 by turning the operating portion 7 of the stepped shaft 3 after the power supply mode is inserted thereinto.

Hereinafter, an operation of the internal mechanism of the guide rail at the tin of tug the operating portion 7 will be descried.

In the structure of FIG. 9, when turning the operating portion 7 projecting from the guide rail 1 to the outside thereof, the entire stepped shaft 3 is moved to the left-hand side, as viewed in this figure, because the stepped shaft 3 has the external thread portion 4.

Further, the thick shaft portion 5 of the stepped shaft 3 is contained within stepped hole 9 of the wedge-like blocks 8. Thus, when the stepped shaft 3 moves to the left-hand side as viewed in this figure, each of the wedge-like blocks 8 is similarly moved to the left-hand side by being pushed by the thick shaft portion 5.

When each of the wedge-like blocks 8 is moved to the left-hand side by a certain distance while being pushed by the corresponding thick shaft portion 5, the inclined wall of each of the wedge-like blocks 8 is brought into contact with the inclined wall of the corresponding wedge-like space 11 provided in the guide rail 1.

After putting into contact with the inclined wall of a corresponding one of the wedge-like spaces 11, each of the wedge-like blocks 8 cannot further move to the left-hand side. However, if each of the wedge-like blocks 8 is further pushed by the corresponding thick shaft portion 5, a force is downwardly exerted on each of the wedge-like blocks 8, as viewed in FIG. 9, because the contact surface between each of the wedge-like blocks 8 and a corresponding one of the wedge-like space 11 is inclined. Since one shaft 3 has a plurality of thick shaft portions 5, a plurality of wedge-like blocks 8 which are independent of one another can be moved simultaneously. Further, since each thick shaft portion 5 pushes a corresponding wedge-like block 8, any portion of a long electrical supply bus 10 can equivalently connect to a guide rail 1. This is important in connecting reliability of the electrical supply bus 10.

At that time, the direction of the force applied onto the stepped shaft 3 is changed from the leftward direction to the downward direction, namely, changed 90 degrees by utilizing the inclined wall of each of the wedge-like blocks 8.

Furthermore, each of the wedge-like blocks 8 is adapted to be able to move upwardly and downwardly with respect to the stepped shaft 3. Therefore, each of the wedge-like blocks 8 starts moving downwardly along the inclined wall of the corresponding wedge-like space 11 when a downward force is exerted thereon. Additionally, when the stepped shaft 3 moves to the left, each of the wedge-like blocks 8 moves downwardly and then cones into contact with the top surface of the preliminarily inserted electrical supply bus 10. Subsequently, each of the wedge-like blocks 8 presses the electrical supply bus 10 against a lower portion of the guide rail 1. Thus, an operation of connecting the electrical supply bus is completed.

Next, effects of the first embodiment of the present invention will be described hereunder.

In the case of the first embodiment of the present invention, the electrical supply bus can easily be connected to the power supply module and so forth only by rotating the operating portion of the stepped shaft after the power supply module is inserted into the case. Thus, there is no need for using special tools. Consequently, the mounting of the modules is facilitated.

Further, the operating portion can be placed outside the case by disposing the operating portion at an end of the guide rail. Moreover, this embodiment eliminates the necessity for tightening the screws in the case after the power supply module is inserted into the case. Thus, the problem occurring in the conventional structure, namely, the difficulty in connecting the electrical supply bus to the module and so on can be eliminated.

In the case of the first embodiment of the present invention, there is no need for tightening the screws at a plurality of places so as to connect the electrical supply bus to the guide rails, differently from the case of the conventional structures. Thus, as compared with the case of employing the conventional structures, the mounting of the power supply (module) can be performed simply and easily.

Moreover, a toggle effect is obtained by using a plurality of wedge-like blocks in the inside of the guide rail. Even if the force of the stepped shaft for turning the operating portion thereof is low, the electrical supply bus and each of the guide rails Can be connected with each other at a high pressure.

Next, a second embodiment of the present invention will be described in detail hereinbelow with reference to the accompanying drawings.

Figure 10:
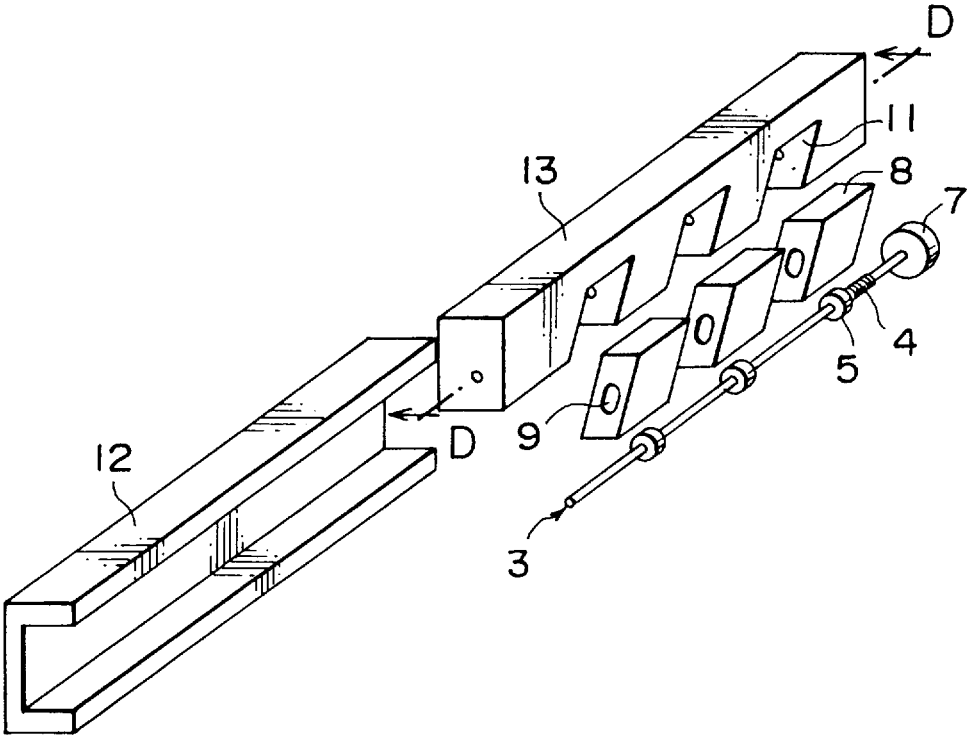
FIG. 10 is an exploded perspective diagram showing a connecting structure of an electrical bus which is a second embodiment of the present invention.
Figure 11:
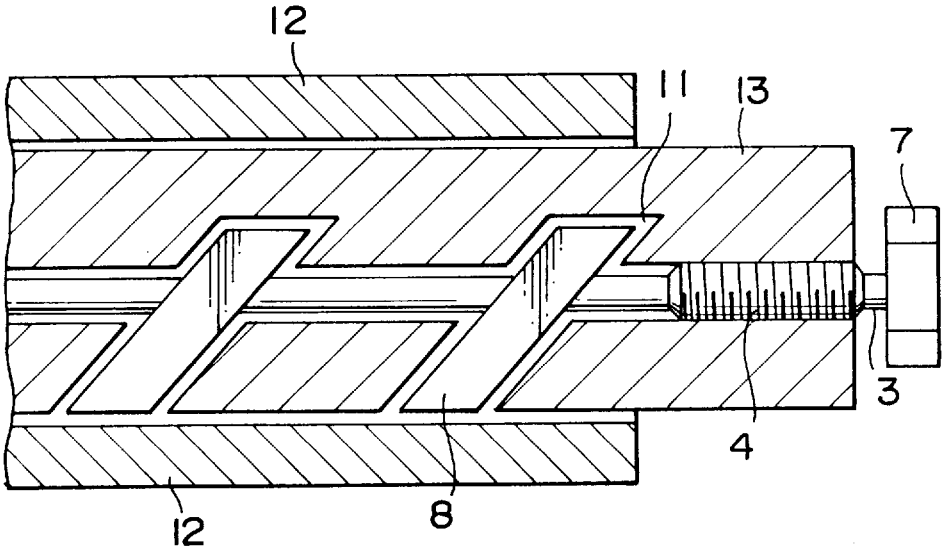
FIG. 11 is a sectional diagram taken on line D—D of FIG. 10 and illustrates the state where the components are assembled.

FIG. 10 is an exploded perspective diagram showing a connecting structure of an electrical bus which is a second embodiment of the present invention. Further, FIG. 11 is a sectional diagram taken on line D—D of FIG. 10 and illustrates the state of the structure after the components are assembled. In the case of the second embodiment of the present invention, an internal mechanism, which uses a plurality of wedge-like blocks 8 and the stepped shaft 3, is incorporated into an electrical supply bus 13, instead of a guide rail 12.

The second embodiment of the present invention is a structure similar to the first embodiment of the present invention, except that the internal mechanism is moved or transferred from the guide rails to the electrical supply bus. Therefore, when the operating portion 7 of the stepped shaft 3 rotated, each of the thick shaft portions 5 of the stepped shaft 3 is contained in the inside of the corresponding wedge-like block 8. Thus, when the stepped shaft 3 moves to the left-hand side, each of the wedge-like blocks 8 are similarly moved to the left-hand side by being pushed by the corresponding thick shaft portion 5.

When each of the wedge-like blocks 8 is moved to the left-hand side by a certain distance while being pushed by the corresponding thick shaft portion 5, the inclined wall of each of the wedge-like blocks 8 is brought into contact with the inclined wall of the corresponding wedge-like space 11 provided in the electrical supply bus 13.

After coming into contact with the inclined wall of a corresponding one of the wedge-like spaces 11 provided in the electrical supply bus 13, each of the wedge-like blocks 8 cannot further move to the left-hand side. However, if each of the wedge-like blocks 8 is further pushed by the corresponding thick shaft portion 5, a force is downwardly exerted on each of the wedge-like blocks 8, viewed in FIG. 11, because the contact surface between each of the wedge-like blocks 8 and a corresponding one of the wedge-like space 11 is inclined.

At that time, the direction of the force applied onto the stepped shaft 3 is changed from the leftward direction to the downward direction, namely, changed 90 degrees by utilizing the inclined wall of each of the wedge-like blocks 8.

Furthermore, each of the wedge-like blocks 8 is adapted to be able to move upwardly and downwardly with respect to the stepped shaft 3. Therefore, each of the wedge-like blocks 8 starts moving downwardly along the inclined wall of the corresponding wedge-like space 11 when a downward force is exerted thereon. Additionally, when the stepped shaft 3 moves to the left, each of the wedge-like blocks 8 moves downwardly and then comes into contact with the inner surface of the lower part of guide rail 12. Then, the electrical supply bus 13 moves upwardly, and the top surface of the electrical supply bus 13 is pushed against the inner surface of the guide rail 12. Thus, an operation of connecting the electrical supply bus is completed.

Next, a third embodiment of the present invention will be described in detail hereinbelow with reference to the accompanying drawings.

Figure 12:
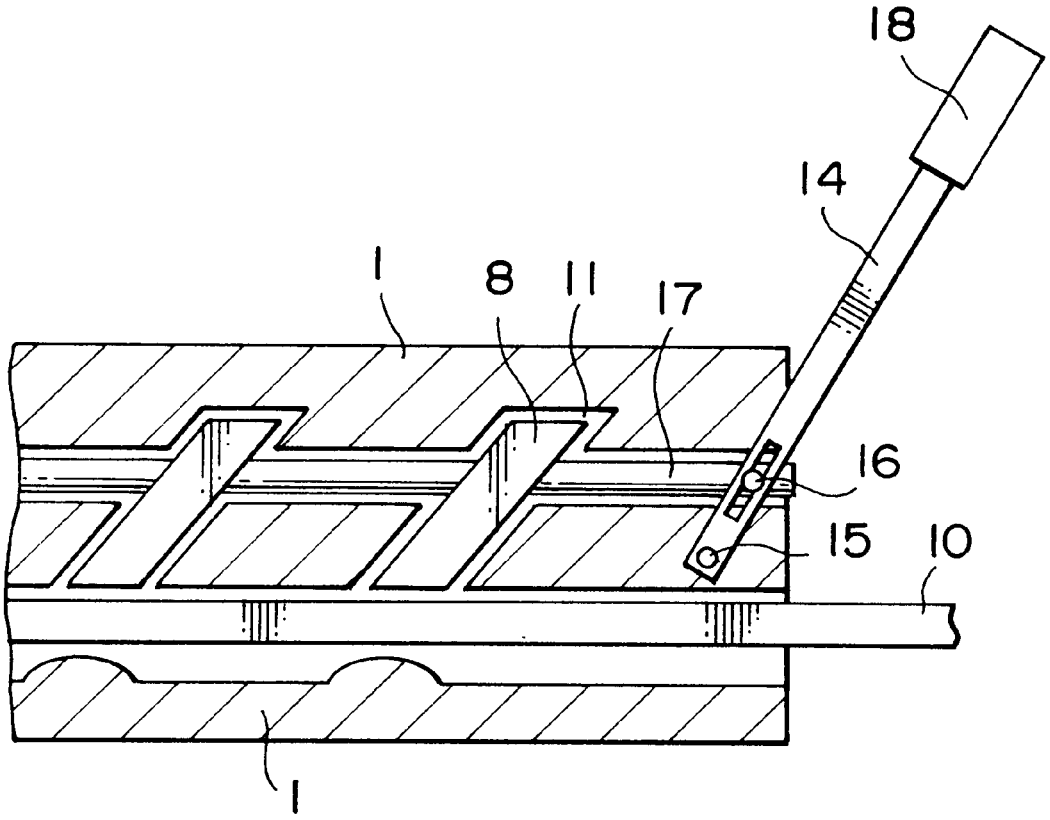
FIG. 12 is a sectional diagram showing a connecting structure of an electrical bus which is a third embodiment of the present invention.

FIG. 12 is a sectional diagram showing a lever structure which is a third embodiment of the present invention. Referring to FIG. 12, there is shown the third embodiment in which a shaft with steps, namely, a stepped shaft 17 for pushing each of wedge-like blocks 8 does not have a screw portion but has a mechanism using a lever 14. Thus, the stepped shaft 17 can be moved in the direction of the shaft by operating an operating portion 18 of the lever 14. In this case, an end portion 15 of the lever 14 is fixed to the guide rail by screws. A connecting portion 16 between the stepped shaft 17 and the lever 14 is moved by rotating the lever 14 around the end portion 15 of the lever 14. Thus, the stepped shaft 17 can be moved in the direction of the shaft.

In the case of the third embodiment of the present invention, the electrical supply bus 10 and the guide rail 1 can be connected with a single stroke of the lever 14. The electrical supply bus can be more simply connected to the guide rail 1, in comparison with the method of connecting the electrical supply bus 10 to the rail 1 by rotating the stepped shaft 17.

Furthermore, an operation of pushing each of the wedge-like blocks 8 by the stepped shaft 17 and connecting the electrical supply bus 10 with the guide rail 1 by utilizing the pushing force is similar to the corresponding operations of the first and second embodiments.

The structure of this third embodiment can be adapted so that a mechanism using a lever is built into the electrical supply bus, similarly as in the case of the second embodiment.

Further, in the case of this third embodiment, an operation of using the lever is simpler than an operation of screwing, in comparison with the aforementioned first and second embodiments. Thus, the facilitation of the mounting of the power supply module can be promoted.

Moreover, a toggle effect is obtained by using a mechanism, which utilizes the principle of a lever, in a portion for moving the stepped shaft by operating a lever. Thus, an operation of connecting the electrical supply bus to the guide rails can be achieved by an easy operation. Moreover, a high contact pressure can be obtained.

As above described, the present invention has the following advantageous effects.

First advantageous effect is that the present invention considerably saves time and labor required for connecting the electrical supply bus to the guide rails and so on.

The reason is that, in accordance with the present invention, a plurality of wedge-like blocks are collectively operated by using the stepped shaft and thus the electrical supply bus can be connected to the rails and so forth by using only a single operating portion or a single lever of the stepped shaft.

Further, the operating portion or the lever can be placed outside the case by adapting the structure so that the operating portion or the lever of the step shaft is provided in an end portion of the guide rail or the electrical supply bus. Thus, troublesome work, such as the screwing in the inside of the case, can be eliminated.

Second advantageous effect is that a high contact pressure is obtained.

The reason is that a toggle effect is obtained when the force exerted in the direction of the shaft is converted into a force exerted in a direction perpendicular to the direction of the shaft by using the inclined wall of each of the wedge-like blocks, and thus the force of pushing the electrical supply bus against the guide rails is increased.

Although preferred embodiments of the present invention have been described above, it should be understood that the present invention is not limited thereto and that other modifications will be apparent to those skilled in the art without departing from the spirit of the invention.

The scope of the present invention, therefore, is to be determined solely by the appended claims.

What is claimed is:

1. In an electronic device having a case, guide rails fixed to said case, and an electrical supply bus, a connecting structure of an electrical supply bus comprising:

said guide rails provided with a plurality of wedge-like spaces;

a plurality of wedge-like blocks respectively housed in said wedge-like spaces;

a stepped shaft, which is inserted in a hole provided in each of said guide rails and has a plurality of thick shaft portions; and said electrical supply bus placed in such a manner as to face said guide rails, wherein, when said stepped shaft moves in a direction of said shaft, each of said thick shaft portions causes a corresponding one of said wedge-like blocks to move, and wherein each of said wedge-like blocks pushes said electrical supply bus against said guide rails.

2. A connecting structure of an electrical supply bus as claimed in claim 1, wherein said stepped shaft has an external thread portion, wherein each of said guide rails has an internal thread portion, and wherein said stepped shaft moves in said direction of said shaft by rotating.

3. A connecting structure of an electrical supply bus as claimed in claw 2, wherein an operating portion of said stepped shaft is placed outside said electronic device.

4. In an electronic device having a case, guide rails fixed to said case, and an electrical supply bus, a connecting structure of an electrical supply bus comprising:

said electrical supply bus provided with a plurality of wedge-like spaces;

a plurality of wedge-like blocks respectively housed in said wedge-like spaces;

a stepped shaft, which is inserted in a hole provided in said electrical supply bus and has a plurality of thick shaft portions; and said guide rails placed in such a manner as to face said electrical supply bus, wherein, when said stepped shaft moves in a direction of said shaft thereof, each of said thick shaft portions causes a corresponding one of said wedge-like blocks to move, and wherein each of said wedge-like blocks pushes said electrical supply bus against said guide rails.

5. A connecting structure of an electrical supply bus as claimed in claim 4, wherein said stepped shaft has an external thread portion, wherein each of said guide rails has an internal thread portion, and wherein said stepped shaft moves in said direction of said shaft by rotating.

6. A connecting structure of an electrical supply bus as claimed in claim 5, wherein an operating portion of said stepped shaft is placed outside said electronic device.

7. A connecting structure of an electrical supply bus as claimed in claim 1 or 4, wherein a lever mechanism is provided at one end of said stepped shaft, and wherein said stepped shaft is moved in the direction of said shaft by operating said lever mechanism.

8. A connecting structure of an electrical supply bus as claimed in claim 7, wherein an operating portion of said lever mechanism is placed outside said electronic device.

9. A connecting structure of an electrical supply bus as claimed in claim 1 or 4, wherein said wedge-like blocks have inclined walls, respectively, and wherein a direction of a force exerted on each of said wedge-like blocks is changed 90 degrees by bringing each of said inclined walls into contact with an inclined wall of a corresponding one of said wedge-like spaces.

10. A connecting structure of an electrical supply bus as claimed in 1 or 4, wherein each of said thick shaft portions is incorporated into a stepped hole bored in each of said wedge-like blocks.

* * * * *